United States Patent [19]

Marzili et al.

[11] Patent Number: 4,691,977

[45] Date of Patent: Sep. 8, 1987

[54] COVER FOR FLAT CABLE CONNECTOR

[75] Inventors: Joseph C. Marzili, Hershey; Brian D. Stephenson, Harrisburg, both of Pa.

[73] Assignee: AMP Incorporated, Harrisburg, Pa.

[21] Appl. No.: 885,378

[22] Filed: Jul. 14, 1986

Related U.S. Application Data

[63] Continuation of Ser. No. 721,255, Apr. 8, 1985, abandoned.

[51] Int. Cl.[4] ..... H01R 11/20

[52] U.S. Cl. ..... 439/404; 439/417

[58] Field of Search ..... 339/97-99, 339/59 R, 59 M, 61 R, 61 M, 17 F, 176 MF

[56] References Cited

U.S. PATENT DOCUMENTS

| | | | |
|---|---|---|---|
| 3,820,055 | 6/1974 | Huffnagle et al. | 339/97 P |
| 3,858,159 | 12/1974 | Worth | 339/99 R |
| 3,993,393 | 11/1976 | Worth | 339/99 R |
| 4,236,778 | 12/1980 | Hughes et al. | 339/97 P |
| 4,327,956 | 5/1982 | Sitzler | 339/97 R |
| 4,410,229 | 10/1983 | Stephenson | 339/97 P |
| 4,557,543 | 12/1985 | McCleerey et al. | 339/97 P |
| 4,581,820 | 4/1986 | Zahn et al. | 339/97 P |

*Primary Examiner*—Gil Weidenfeld
*Assistant Examiner*—Paula A. Austin
*Attorney, Agent, or Firm*—F. Brice Faller; Bruce J. Wolstoncroft; David L. Smith

[57] ABSTRACT

Connector for ribbon cable comprises a housing having therein two rows of terminals with slotted plate portions extending above cable receiving face of housing for reception in respective passages in cover latchably secured by barbs on insulation piercing arms which define slots. Each passage has ramps therein which deflect arms toward opposite sidewalls of passage until barbs snap over shoulders so that arms are coplanar. The slots do not narrow as cover is applied.

4 Claims, 9 Drawing Figures

COVER FOR FLAT CABLE CONNECTOR

This application is a continuation of application Ser. No. 721,255 filed Apr. 8, 1985, now abandoned.

BACKGROUND OF THE INVENTION

The present invention relates to a connector for a flat multiconductor cable, and particularly to an improved cover for a connector of the type having terminals which are individually latched to the cover.

A known connector sold by AMP Incorporated as its AMP-LATCH connector comprises a housing, a plurality of stamped and formed terminals therein, and a cover. The housing has a mating face and an opposed cable receiving face, the terminals having substantially planar slotted plate portions extending above the cable receiving face. Each slotted plate portion comprises a pair of insulation piercing arms defining a slot therebetween and a pair of outwardly directed barbs toward the free ends of respective arms. The cover has a terminal receiving face, an opposed outer face, and passages therethrough aligned to accept the arms of respective slotted plate portions. Each passage has opposed internal sidewalls facing the rolled surfaces of the terminal and opposed internal endwalls facing the sheared surfaces of the terminal. Each endwall has thereon a shoulder on which a sheared surface of a respective barb is seated to retain the cover when a cable is terminated.

The above described connector is generally disclosed in U.S. Pat. No. 3,820,055, although the current product differs slightly in details such as the profile of the passages through the cover. To terminate a cable, which is profiled as individual conductors on 0.050 in. centers in a common jacket of insulation, the cable is aligned with complementary fluting on the terminal receiving face of the cover and the cover is aligned with the housing and pressed thereagainst so that each pair of arms pierces the cable and a conductor is forced into the slot defined thereby. Arms are initially deflected toward each other, narrowing the slot, then return as barbs latch onto the shoulders. This results in a loss of resilient force and reduction of contact integrity between the deformed conductor, typically a single strand of copper wire, and the terminal.

U.S. Pat. No. 4,410,229 discloses a modified form of the above connector employing terminals having laterally formed ears and shoulders on a sidewall of each passage. Both arms of each pair are thus deflected normally of the plane of the slotted plate portion during termination, eliminating any narrowing and subsequent widening of the slot. The disclosed connector suffers the disadvantage of requiring the manufacture of both a new terminal and a new cover; it would be desirable to attain the advantage through the mere expedient of manufacturing a modified cover.

SUMMARY OF THE INVENTION

The present invention, therefore, is characterized by an improved cover having ramp means in each passage which directs each arm toward an adjacent sidewall as the cover is received on the housing during termination. Ramps on respective opposite sidewalls of each passage bear against respective arms on opposite rolled surfaces of the slotted plate portion to direct the arms oppositely from the plane of the plate portion during termination. The barbs resile onto respective shoulders from side edges thereof to latch the cover when termination is completed. Since the arms are not forced together and allowed to resile apart, contact integrity is maintained.

The subject invention offers the advantage of wiping the conductor in opposite directions parallel to its axis during termination, and subsequently placing the terminated portion of the conductor in axial compression when the arms return to a coplanar relationship.

U.S. Pat. Nos. 3,858,159 and 3,993,393 disclose terminals which place the terminated portion of the conductor in axial tension to achieve a similar advantage, however, these are terminals of special manufacture which further are not individually latched to the cover.

DETAILED DESCRIPTION OF THE PREFERRED EMBODIMENT

Figure 1:
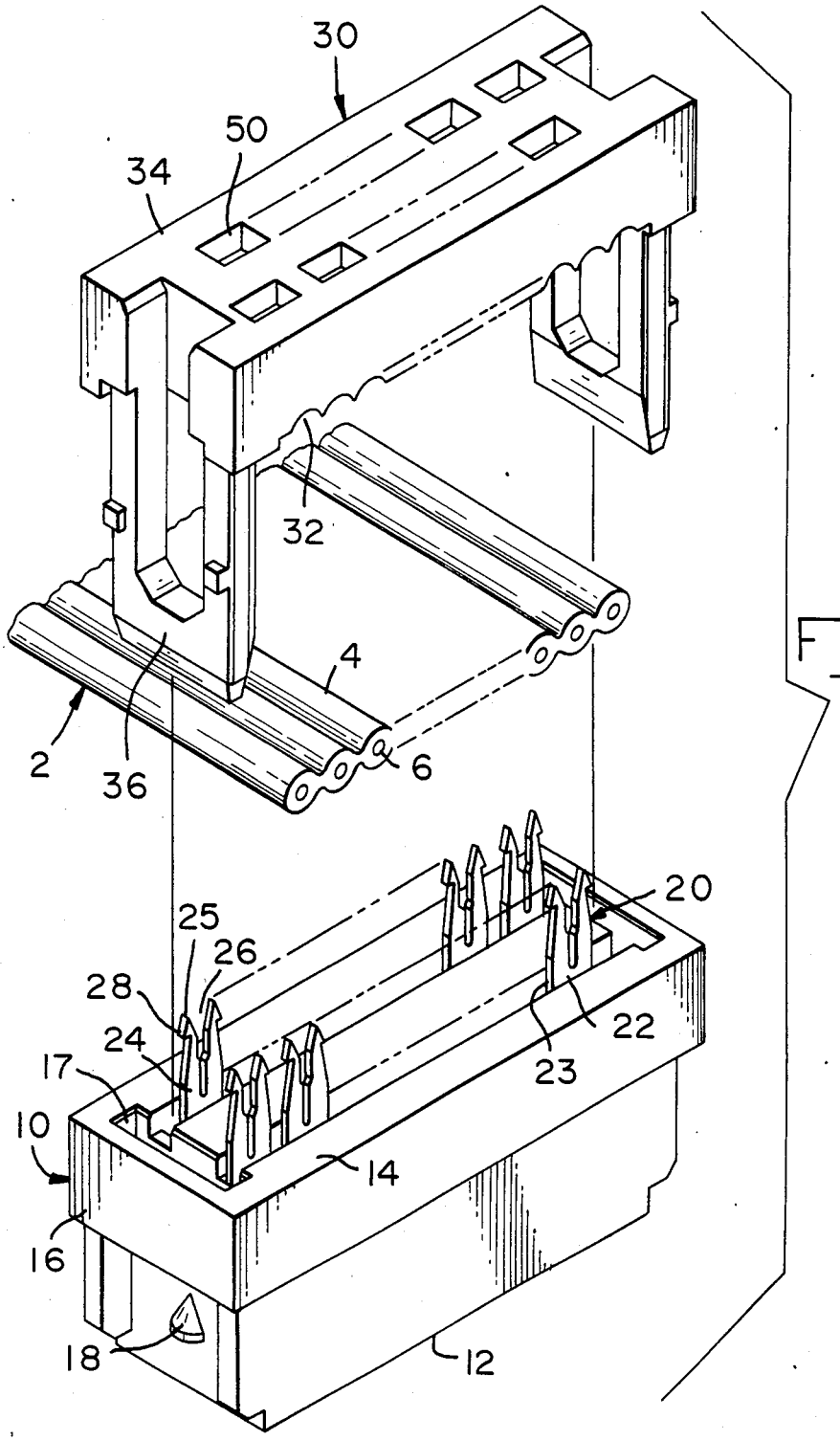
FIG. 1 is an exploded perspective of the subject connector.

FIG. 1 is a perspective of a housing 10 loaded with terminals 2, a flat cable 20 poised for termination thereto, and a cover 30 which serves to align the individual conductors 6 with respective terminals 20. The housing is molded of insulative plastic and has a mating face 12, an opposed cable receiving face 14, and opposed end walls 16. The slotted plate portion of each terminal 20 extends above face 14 and comprises a pair of symmetric arms 24 having pointed free ends 25 which pierce the insulation 4 on either side of a respectively aligned conductor 6. The arms 24 define a slot 26 therebetween and have a pair of respective outward facing barbs 28 which engage the cover 30 as will be described. The terminals are stamped from phosphorus bronze strip stock to yield the profile just described. Each terminal 20 has opposed major rolled surfaces 22, which preexisted on the strip stock, and sheared surfaces 23 therebetween, which were created by the action of shear dies. The cover 30 has a terminal receiving face 32 which is fluted to align the extruded cable jacket 4 thereagainst, an opposed outer face 34, and passages 50 therebetween aligned to accept the arms 24 of respective slotted plate portions. Latch arms 36 are received in slots 17 and engage lugs 18.

The salient features apparent in FIG. 1 are common to both the prior art connector and the connector of the present invention, the difference residing in the passages 50 and their cooperation with arms 24 during termination.

Figure 1A:
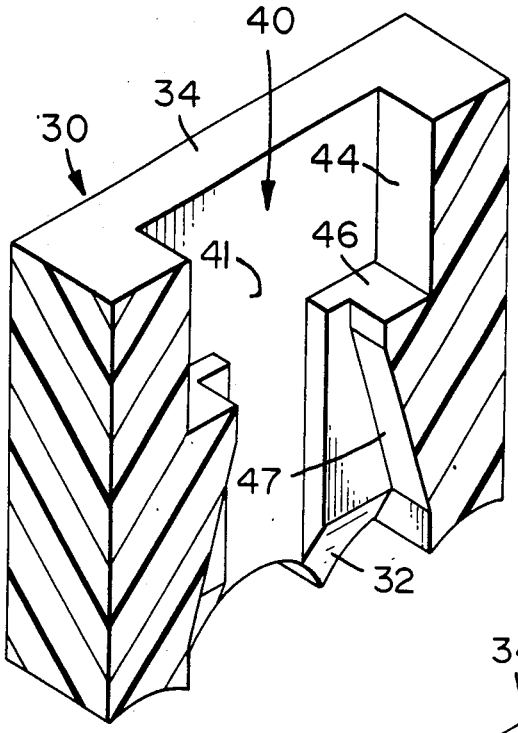
PRIOR ART FIG. 1A
FIG. 1A is a cutaway perspective of a prior art terminal receiving passage.

FIG. 1A shows the prior art passage 40 extending between faces 32, 34 and defined by opposed parallel sidewalls 41 and opposed parallel endwalls 44, the endwalls having respective shoulders 46 thereon which face the outer face 34. A pair of opposed inclined surface 47 extend from face 32 to respective shoulders 46 and serve to urge arms 24 together to close slot 26 during termination. When the cable 2 is sandwiched between the housing 10 and cover 30, the arms spring back and barbs 28 engage respective shoulders 46.

Figure 1B:
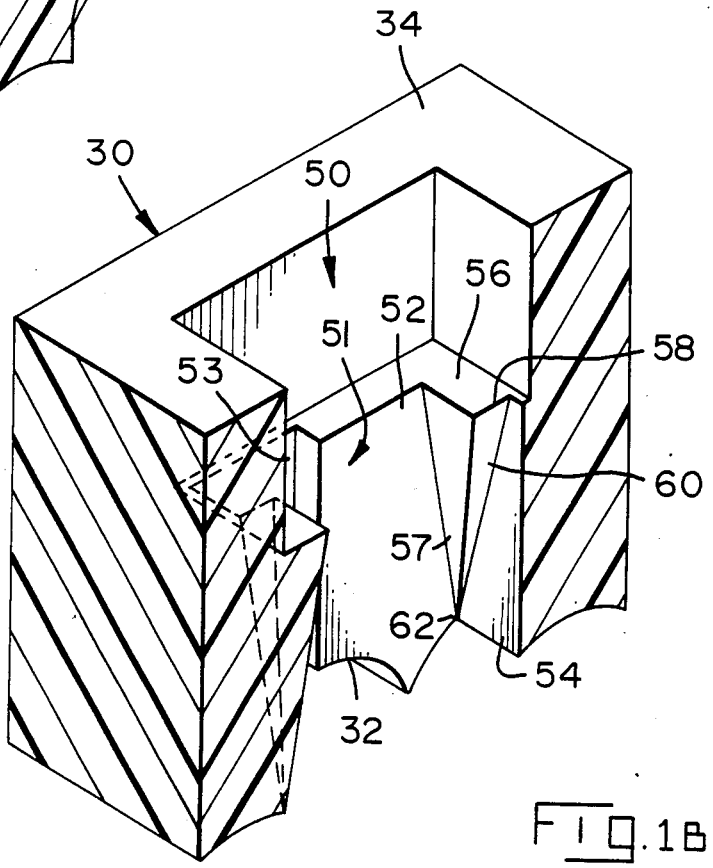
FIG. 1B is a cutaway perspective of the inventive terminal receiving passage.
Figure 4A:
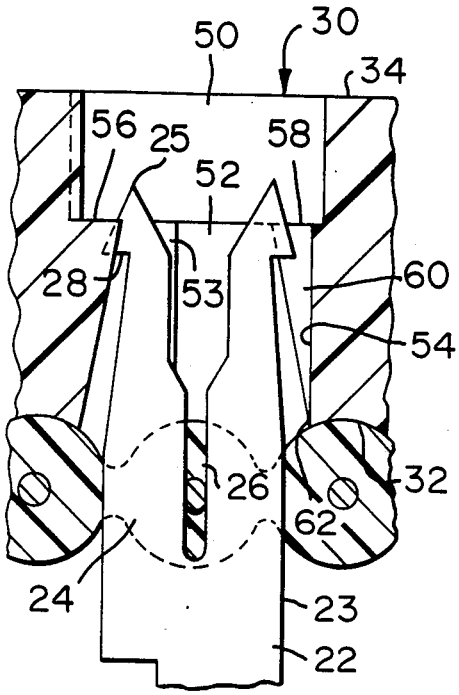
FIG. 4A is a side section of a passage as a terminal is received.
Figure 4B:
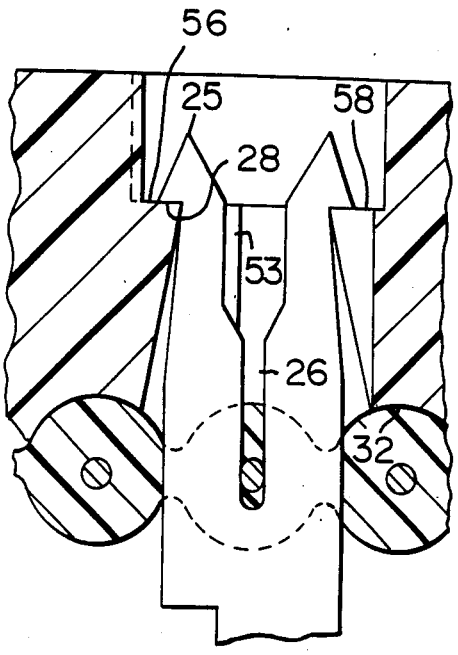
FIG. 4B is a side section with the terminal fully received.
Figure 5A:
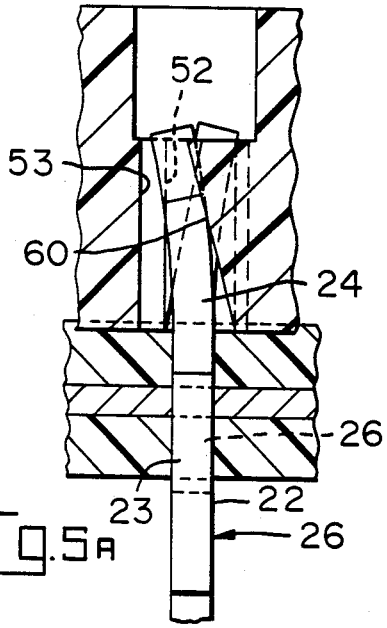
FIG. 5A is an end section of a passage as a terminal is received.
Figure 5B:
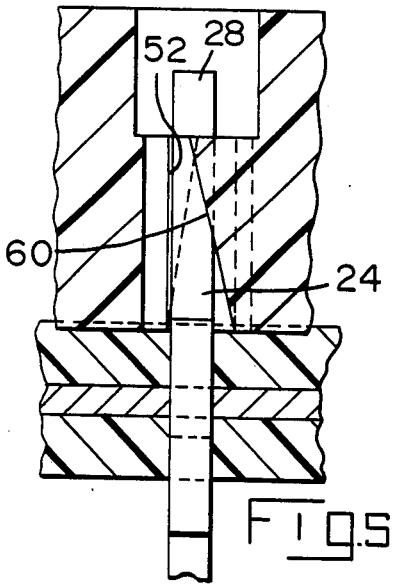
FIG. 5B is an end section with the terminal fully received.

FIG. 1B shows the inventive passage 50 extending between faces 32, 34 and defined by opposed parallel sidewalls 51 and opposed parallel endwalls 54, the endwalls having respective shoulders 56 thereon which face the outer face 34. A pair of opposed inclined surfaces 57 extend from face 32 to respective shoulders 56, but they do not serve to urge the arms 24 together during termination. Rather, surfaces 57 serve only to profile the passage 50 to accommodate the terminal 20, as shown in FIG. 4B. Each shoulder 56 is laterally bounded by a side edge 58 paralleling the adjacent sidewall 51, the edge 58 defining the head of a ramp 60 whose foot 62 lies toward cable receiving surface 32. The ramps 60 face opposite sidewalls 51 toward respective endwalls 54 of each passage 50, the planes of the ramps 60 in each passage 50 crossing the center plane between sidewalls 51 from opposite sides thereof. Referring also to FIGS. 4A and 5A, the ramps 60 bear against respective arms 24 on opposite rolled surfaces 22 of the slotted plate portion to direct the arms 24 oppositely from the plane of plate during termination. Referring also to FIG. 5B, the barbs 28 then engage respective shoulders 56 as the arms resile back to a substantially coplanar relationship.

Figure 2:
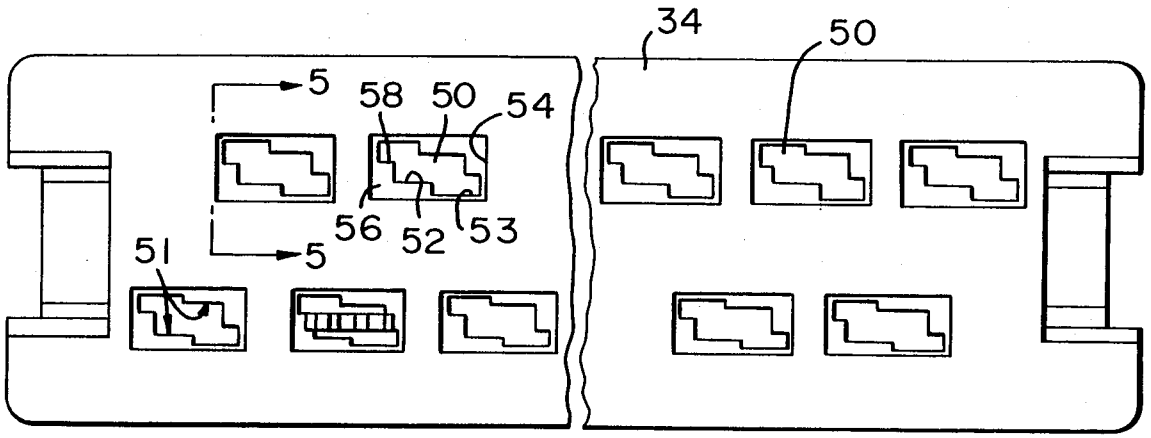
FIG. 2 is a top plan view of the inventive cover.

FIG. 2 is a plan view of the outer surface 34 of the cover 30. Note that shoulders 56 are part of a continuous shelf in each passage 50, the planes of directly opposed center portions 52 of opposite sidewalls 51 being closer together than the planes of diagonally opposite end portions 53. The end portions 53 allow for lateral flexure of the arms 24 during termination while the center portions 52 assure centering after termination, as shown in FIGS. 5A and 5B.

Figure 3:
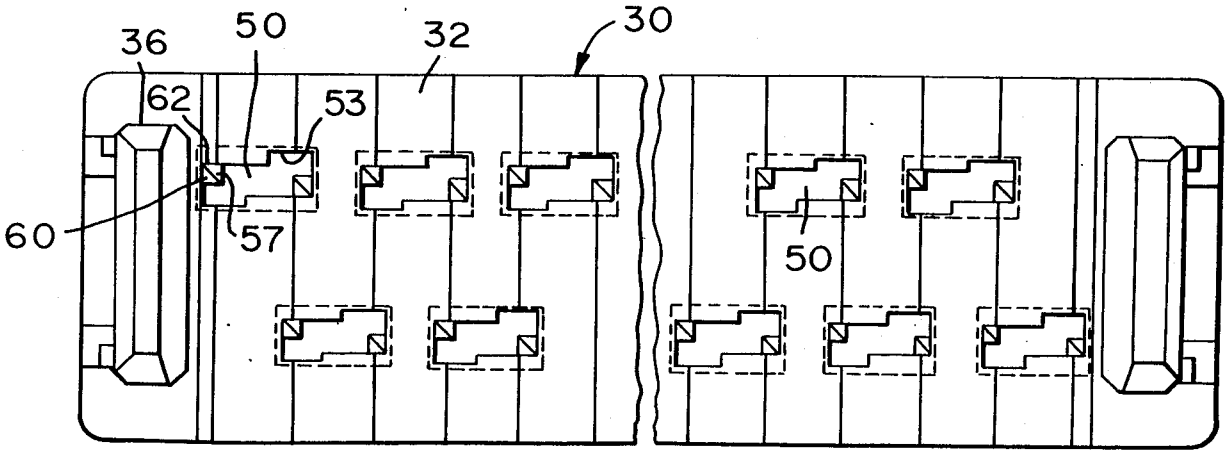
FIG. 3 is a bottom plan view of the inventive cover.

FIG. 3 is a plan view of the cable receiving surface 32 of the cover 30. Each passage 50 opens in the center of a flute, which flutes are centered as the conductors in the cable 2 to assure proper alignment with the terminals 20. The inclined facing surfaces 57 and ramps 60 are as previously described.

We claim:

1. An electrical connector for electrical termination to a flat cable comprising:

housing means having a mating face and an opposed cable receiving face;

a plurality of terminals mounted in the housing means having substantially planar slotted portions extending above the cable receiving face, each slotted plate portion comprising a pair of insulation piercing arms defining a slot therebetween and a pair of outwardly directed barbs adjacent the free ends of respective arms;

cover means having a terminal receiving face, an opposed outer face, and passages therethrough aligned to accept the arms of respective slotted plate portions;

each passage having opposed internal sidewalls and opposed internal endwalls, each endwall having thereon a ledge on which a shoulder of a respective barb is seated to retain the cover when a cable is terminated thereto; and ramp means provided in each passage, each ramp defining a bearing surface against which the respective arm of the slotted plate portion engages as the cover means is inserted into the housing means, directing the arm normally of the plane of the slotted plate portions during termination of the flat cable to the slotted plate portions of the terminals causing the slotted plate portions to transversely wipe respective conductors of the flat cable, ensuring a positive electrical connection therewith.

2. A connector as in claim 1 wherein the ramps face opposed sidewalls, the ramps bearing against respective arms on opposite rolled surfaces of the slotted plate portion to direct the arms oppositely from the plane of said portion during termination.

3. A connector as in claim 1 wherein each ramp has a foot toward the terminal receiving face and a head toward the outer face, the planes of the ramps in each passage crossing the center plane between sidewalls from opposite sides of said plane.

4. A connector as in claim 1 wherein each ledge has a side edge which defines the head of a respective ramp, the side edges of the ledges in each passage facing respective opposite sidewalls, the barbs resiling onto respective ledges from side edges thereof to latch the cover to the housing.

* * * * *